United States Patent [19]

Lysinger et al.

[11] 3,963,004

[45] June 15, 1976

[54] TWO-PIECE VALVE BRIDGE

[75] Inventors: Glenn W. Lysinger, Detroit; James S. Sears, Fowlerville, both of Mich.

[73] Assignee: General Motors Corporation, Detroit, Mich.

[22] Filed: May 8, 1975

[21] Appl. No.: 575,609

[52] U.S. Cl. ..... 123/90.4; 123/90.22; 123/90.23

[51] Int. Cl.[2] ..... F01L 1/18

[58] Field of Search ..... 123/90.4, 90.22, 90.23

[56] References Cited

UNITED STATES PATENTS

| | | | |
|---|---|---|---|
| 2,309,291 | 1/1943 | Anderson | 123/90.22 |
| 2,380,051 | 7/1945 | Kettering | 123/90.4 |
| 2,521,176 | 9/1950 | Kutz | 123/90.22 |
| 3,056,392 | 10/1962 | Daub | 123/90.22 |
| 3,400,693 | 9/1968 | Siding | 123/90.4 |
| 3,613,647 | 10/1971 | Mettig | 123/90.22 |
| 3,633,556 | 1/1972 | Inoue | 123/90.22 |

*Primary Examiner*—Charles J. Myhre
*Assistant Examiner*—Daniel J. O'Connor
*Attorney, Agent, or Firm*—Arthur N. Krein

[57] ABSTRACT

A two-piece valve bridge for the valve gear mechanism of an internal combustion engine of the type having a rocker arm pivotally mounted on a rocker shaft, a cylinder head, a guide rod mounted on the cylinder head and, a pair of valves, the stems of which extend up through the cylinder head on opposite sides of the guide rod; the two-piece valve bridge being positioned to be actuated by the rocker arm in engaing the valve stems to effect operation of the valves and including a glide or slider having a hollow shank portion reciprocally mounted on the guide rod and a head having a partial spherical bearing surface on the underside thereof and, a bridge with a central apertured cavity therein which encircles the shank portion of the guide to seat against the bearing surface thereof, each end of the bridge engaing one of the valve stems.

3 Claims, 4 Drawing Figures

TWO-PIECE VALVE BRIDGE

This invention relates to a valve gear for an internal combustion engine of the type wherein two valves are operated by a common valve bridge actuated by means of a rocker arm and, in particular, to a two-piece valve bridge structure for such a valve gear.

A conventional valve gear for an internal combustion engine of the type wherein two valves are operated by a common valve bridge actuated by means of a rocker arm and, in particular, to a two-piece valve bridge structure for such a valve gear.

A conventional valve gear for an internal combustion engine of the type having a pair of valves which are simultaneously operated by a common valve bridge or cross head, the bridge is normally suitably guided for reciprocating movement whereby to effect operation of the valves and means, for example, adjuster screws, are normally associated with at least one side of the bridge whereby adjustment may be made to compensate for differences in valve height. In such arrangements, the adjusting screw must be accurately adjusted to compensate for the differences in valve height and once adjusted must be securely locked in position to prevent movement of the adjusting screw so that the performance of the engine will not be effected.

It is therefore the principal object of this invention to improve a valve gear whereby a two-piece valve bridge is used in the valve gear whereby to automatically compensate for variation in valve height.

Another object of this invention is to provide an improved valve bridge whereby the valve bridge is of two-piece construction, both pieces being readily and economically fabricated.

These and other objects of the invention are obtained by means of a two-piece valve bridge for simultaneous operation of a pair of valves by a single rocker arm, the two-piece valve bridge including a machine guide or slider with a partial spherical bearing surface on the underside of the head thereof and a hollow shank portion extending from the head which is adapted to slide on a guide pin pressed or otherwise secured into the cylinder head of an engine, the head of the guide or slider thus being positioned for actuation by the actuator end of the rocker arm. A bridge, in the form of a steel stamped beam with a central apertured cavity therein, encircles the shank of the guide or slider and seats against the bearing surface of the guide or slider, the opposite ends of the bridge each engaging a valve to be actuated.

For a better understanding of the invention, as well as other objects and further features thereof, reference is had to the following detailed description of the invention to be read in connection with the accompanying drawings, wherein.

Figure 1:
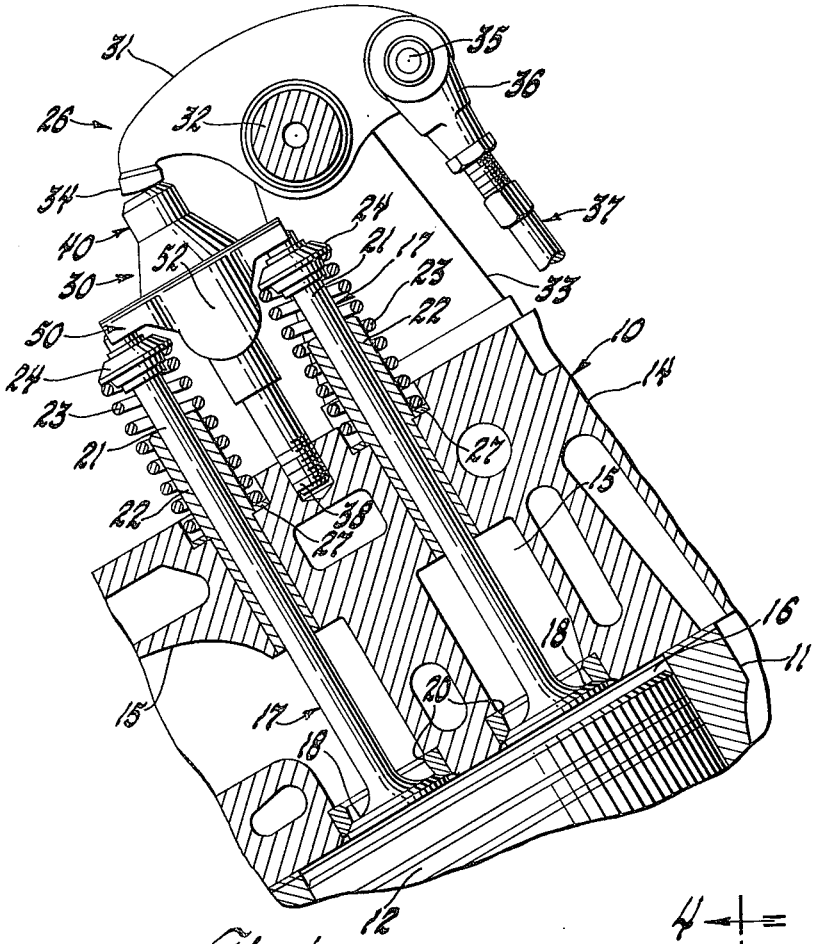
FIG. 1 is a sectional view through a portion of an internal combustion engine showing the valve gear for operating a pair of valves, the valve gear including a two-piece valve bridge in accordance with the invention.
Figure 3:
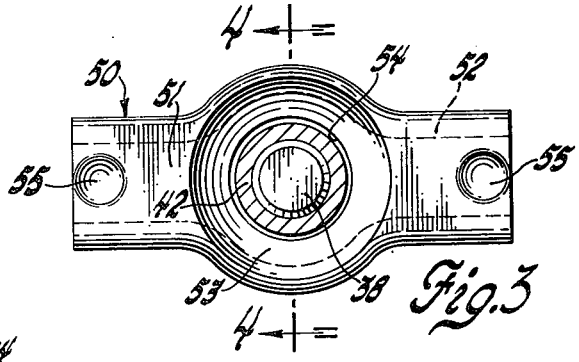
FIG. 3 is a view taken along line 3—3 of FIG. 2.

As partly shown in FIG. 1, the engine, indicated generally at 10, comprises a cylinder block 11 having at least one cylinder bore therein reciprocably mounting a piston 12.

A cylinder head 14 mounted on and sealed with respect to the cylinder block closes the upper end of the cylinder bore to form therewith in the reciprocating piston an expandable combustion chamber. The cylinder head 14 is provided with a passage 15 opening into the combustion chamber 16, through a pair of ports, the flow therethrough being controlled by two poppet type valves 17, the heads 18 of which are adapted to seat against the valve seat inserts 20 mounted in the port openings. For the purpose of describing the invention, the passage 15 is an exhaust passage, but it should be realized that is may be either an intake or an exhaust passage for the engine.

Each of the poppet valves 17 has a stem 21 which is reciprocally mounted in a valve guide 22 having a press fit into a mounting or valve guide bore extending through the cylinder head and intersecting the passage 15, with the upper end of each valve stem projecting above the cylinder head.

In a conventional manner, each valve 17 is normally maintained in a closed position by a return spring 23 encircling the upper portion of the stem 21 of the valve, with one end of the spring abutting against a spring seat 27 on the cylinder head and the other end engaging a conventional spring cap or retainer 24 suitably secured to the stem of the poppet valve by a conventional valve lock 25, which may be in the form of conically tapered split keys which are held on the stem by the wedging action of the cooperatively tapered portion of the spring retainer 24.

The valves 17 are adapted to be actuated in unison between their closed and open positions by the camshaft timed operation of a valve gear or actuator linkage mechanism indicated generally at 26. This linkage mechanism includes a bridge mechanism, generally indicated 30, which, in accordance with the invention, is a two-piece bridge assembly, one portion of which defines a pair of arms to engage the upper end surfaces of the stems 21 of valves 17. A rocker arm 31 is pivotally journalled intermediate its ends on a shaft 32 which is supported above the cylinder head by suitably spaced brackets 33, only one of which is shown, suitably secured to the cylinder head 14. One end of the rocker arm 31 is provided with a tappet portion 34 which engages the upper portion of the bridge 30 to effect reciprocal movement of this bridge assembly, and the other end of the rocker arm 31 distal from the tappet 34 is pivotally connected at 35 to a clevis member 36 forming the upper end of a cam operated push rod assembly 37 which is suitably reciprocated in a conventional manner by a camshaft, not shown, of the engine. The rocker arm 31 is reciprocably supported by a guide rod 38 extending from the cylinder head and suitably secured thereto as by a press fit or, as shown, by threaded engagement in a threaded bore provided for this purpose in the cylinder head 14 in alignment with the axis of the valves 17 and located approximately equal distances therebetween.

Figure 2:
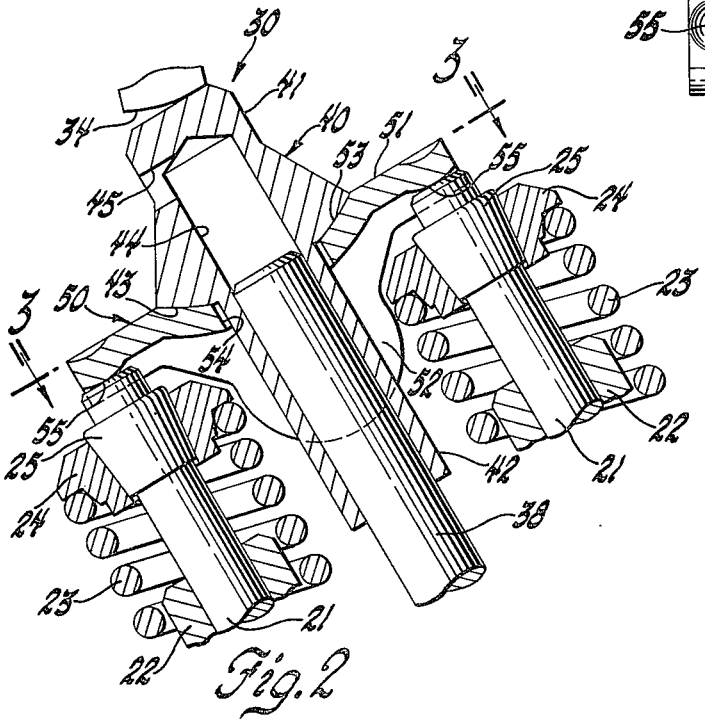
FIG. 2 is an enlarged sectional view of a portion of FIG. 1 showing in detail the two-piece valve bridge structure.
Figure 4:
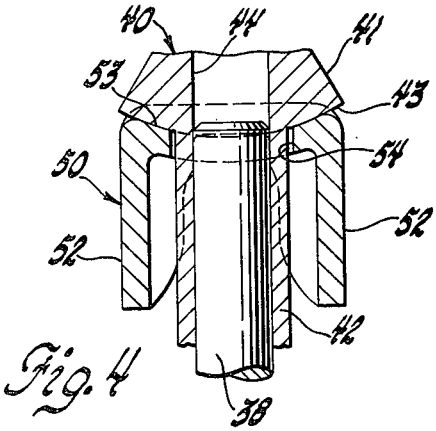
FIG. 4 is a sectional view taken along line 4—4 of FIG. 3.

Referring now to the subject matter of the invention, the bridge assembly 30, as best seen in FIG. 2, consists of two elements that include a guide or slider 40, which may be a screw machine part, and a pallet member or bridge 50 which may be a steel stamped part. Again referring to FIG. 2, the guide or slider 40, hereinafter referred to as the guide, is provided with an enlarged annular head 41 including an enlarged conically formed lower portion with a reduced diameter shank 42 extending therefrom with an intervening semi-spherical bearing surface or shoulder 43 therebetween which is formed on the underside of the conical portion of the head 41. The shank of the guide or slider 40 is provided with a bore 44 that extends from the free end of the shank therethrough into the head 41 where it communicates with an intersecting radial oil passage 45, the internal diameter of the bore 44 is such so as to slidably receive the guide rod 38 whereby the guide 40 can be reciprocally supported by the guide rod. The upper free end of the head 41 of guide 40 is thus retained in alignment by the guide rod for abutment against the tappet portion 34 of the rocker arm 31.

The pallet or bridge 50 comprises a web 51 with integral depending flanges 52 along both side edges of the web whereby to impart the requisite strength and rigidity to this element. A central semi-spherical saddle portion 53, formed complementary to the bearing shoulder 43, is formed in the web 51 to provide a socket bearing surface on the side of the web opposite to the depending flanges for mating with the ball or bearing surface of the guide provided by the bearing surface or shoulder 43 of guide 40. An enlarged aperture 54 is provided concentrically in the saddle portion 53 with the aperture being of a diameter, as seen in FIG. 2, sufficiently greater than the outside diameter of the shank 42 of the guide 40 to permit pivotal movement of the bridge 50 relative to the guide 40 whereby the bridge can pivot about the guide to compensate for any variation in the height of the valve stems 21 when the valves 17 are seated as shown in FIG. 1, and thus bridge 50 may be referred to as a floating bridge. The portions of the web 51 extending from opposite sides of the saddle portion form a pair of arms, each arm having adjacent to its free end an arcuately or spherically deformed pallet portion 55 therein which is engageable with the upper end surface of the stem 21 of the valve 17 with which it is associated.

As assembled, the shank 42 of guide 40 extends through the aperture 54 in the web portion of bridge 50 and slidably encircles the free end of guide rod 38 to be guided thereby for reciprocation relative thereto, with each pallet portion 55 of the bridge 50 then positioned to abut against the upper surface of the stem 21 of the valve 17 with which it is associated. With this arrangement, the saddle portion 53 of the guide socketably receives the bearing surface 43 of guide 40.

In the embodiment shown, the bridge assembly 30 is not a spring-loaded bridge, as this term is normally used, and instead the return spring 23, normally used to bias the valves in a valve closing direction, are used, by engagement of the bridge 50 against the valve stems, to effectively bias the bridge 50 in a direction, upward with reference to FIGS. 1 and 2, so that its saddle portion 53 is retained in abutment with the bearing surface 43 of guide 40 whereby the upper surface of the head 41 of the guide engages the tappet portion 34 of the rocker arm 31. Thus, as the rocker arm 31 is oscillated during engine operation, it will impart corresponding reciprocating movement of the bridge assembly 30 to effect operation of valves 17. It should, however, be realized that a separate spring, not shown, for example, encircling the guide rod 38, can be used to spring-load the bridge assembly 30, if it is desired to have a spring-loaded bridge in a particular engine design, as is well known in the art.

The ball and socket type joint between the guide 40 and bridge 50 allows for proper alignment with the valves 17 with maximum allowable condition of valve height differences. The elements of the bridge assembly 30 thus have the advantage of being self-aligning and reversible during assembly.

The above described elements of the valve gear mechanism, including bridge assembly 30 and guide rod 38, can be lubricated in a suitable manner, as by a conventional splash lubricating system, not shown or described, since the details of such a lubrication system are not deemed necessary for an understanding of the subject bridge assembly of the invention.

What is claimed is:

1. A multi-valve actuating bridge assembly for an internal combustion engine of the type having a cylinder head, a pair of valves including stems slidably received through guide sleeves fitted into the cylinder head, a guide rod fixed to the cylinder head and a rocker arm pivotally mounted in spaced relation from the stems of the valves, said bridge assembly including a guide having a shank slidable on the guide rod, a head engageable by the rocker arm and a semi-spherical shoulder therebetween and, a bridge comprising a web having valve stem engaging end portions, a semi-spherical saddle portion in said web intermediate said end portions, a circular aperture through said semi-spherical saddle portion of said web concentric therewith and depending sides integrally connected to said web on opposite sides thereof, said shank extending through said aperture with said web positioned so that said semi-spherical saddle portion of said bridge socketably receives said semi-spherical shoulder of said guide.

2. A valve bridge assembly for use in an internal combustion engine having a cylinder head, a pair of valves mounted in the cylinder head for parallel reciprocation between valve open and valve closed positions, individual spring means for biasing each of the valves toward its closed position, a rocker arm, a shaft extending transversely of the reciprocable axes of two adjacent valves and mounting said rocker arm for oscillatory movement relative thereto and a guide rod fixed to the cylinder head between the valves in alignment therewith, said bridge assembly including a guide having an enlarged head and a tubular shank portion extending therefrom with a semi-spherical intervening shoulder therebetween, said shank having an axial extending bore therein to be slidably received on the guide rod with said head positioned to be engaged by the rocker arm and a bridge having a web and dependent sides integrally connected to said web, an apertured semi-spherical saddle in said web on the side of said web opposite to said dependent side, said shank of said guide extending through said apertured semi-spherical saddle in said web with said semi-spherical saddle positioned to socketably receive said semi-spherical shoulder of said guide, said web being of a length whereby its end portions will each engage the stem end of one of the valves.

3. A valve bridge for use in the valve operating mechanism of an internal combustion engine of the type having a cylinder head, a pair of spaced apart poppet valves, each valve including a valve stem slidably received in the cylinder head to extend outward therefrom, each valve normally being held seated by a spring means associated with the valve, a guide rod fixed to the cylinder head and extending therefrom in parallel relation to the valve stems and between the valve stems and, a rocker arm for operating the valves, said valve bridge including a guide having an enlarged annular head with a reduced diameter shank extending concentrically therefrom and with an intervening semi-spherical bearing shoulder therebetween, said shank having a longitudinal bore extending from its free end whereby said guide is slidable on the guide rod with the free end of said head positioned to be engaged by the rocker arm, and a bridge having a central semi-spherical dished bearing portion formed complementary to said bearing shoulder with arms extending from opposite sides thereof and of a length for engagement with the valve stems, said bearing portion having a central aperture therethrough whereby said shank is loosely received through said central aperture of said bridge with said bearing portion of said bridge positioned to abut against said bearing shoulder of said guide and with said arms of said bridge thereby being positioned to engage the ends of the valve stems.

* * * * *